US010682781B2

(12) United States Patent
Perini

(10) Patent No.: US 10,682,781 B2
(45) Date of Patent: Jun. 16, 2020

(54) APPARATUS AND METHOD FOR MOVING LOGS WITHIN CUTTING-OFF MACHINES

(76) Inventor: Fabio Perini, Viareggio (Lucca) (IT)

( * ) Notice: Subject to any disclaimer, the term of this patent is extended or adjusted under 35 U.S.C. 154(b) by 0 days.

(21) Appl. No.: 13/466,494

(22) Filed: May 8, 2012

(65) Prior Publication Data

US 2012/0216661 A1 Aug. 30, 2012

Related U.S. Application Data

(63) Continuation of application No. 10/547,435, filed as application No. PCT/IT2004/000139 on Mar. 22, 2004, now abandoned.

(30) Foreign Application Priority Data

Apr. 24, 2003 (IT) ..... FI2003A0115

(51) Int. Cl.

| | |
|---|---|
| ***B26D 7/06*** | (2006.01) |
| ***B26D 3/16*** | (2006.01) |
| ***B26D 7/02*** | (2006.01) |
| *B26D 7/01* | (2006.01) |

(52) U.S. Cl.

CPC ..... *B26D 7/0608* (2013.01); *B26D 3/161* (2013.01); *B26D 7/02* (2013.01); *B26D 7/0625* (2013.01); *B26D 7/0683* (2013.01); *B26D 2007/013* (2013.01); *Y10T 83/04* (2015.04); *Y10T 83/0515* (2015.04); *Y10T 83/2183* (2015.04); *Y10T 83/4792* (2015.04); *Y10T 83/647* (2015.04); *Y10T 83/654* (2015.04)

(58) Field of Classification Search

CPC ..... Y10T 83/4403; Y10T 83/4567; Y10T 83/4589; Y10T 83/4592; Y10T 83/4594; Y10T 83/4615; Y10T 83/463; Y10T 83/4637; Y10T 83/6633; Y10T 83/6638; Y10T 83/6656; Y10T 83/6539; Y10T 83/2192; Y10T 83/2194; Y10T 83/445; Y10T 83/4458; B26D 7/06; B26D 7/0608; B26D 7/0625; B26D 7/0641; B27B 31/006; B27B 1/00; B27B 1/02

USPC ..... 83/207, 251, 260–262, 270, 276, 279, 83/435.2, 436.2, 437.1, 732, 155, 155.1, 83/206, 209

See application file for complete search history.

(56) References Cited

U.S. PATENT DOCUMENTS 3,133,574 A * 5/1964 Reichel ..... B26D 7/0608 83/177
3,144,893 A * 8/1964 Dahms ..... B26D 7/30 83/209
3,880,295 A * 4/1975 Wyslotsky ..... 414/18
(Continued)

*Primary Examiner* — Phong H Nguyen
(74) *Attorney, Agent, or Firm* — McGlew and Tuttle, P.C.

(57) ABSTRACT

Apparatus for moving logs (2) within cutting-off machines. The apparatus includes a platform (1) with one or more longitudinal channels (10) inside which the logs to be cut are disposed, and a pusher device (3) acting in correspondence of the platform (1) and intended for acting on the back of the logs (2) to push them, along respective guide channels (10), toward a cutting device (4) disposed downstream. The apparatus includes a clamping device (5) disposed intermediate between the pusher device (3) and the cutting device (4) and intended for engaging the logs (2) which are pushed along the channels (10) of platform (1) by the pusher device (3) and driving them along up to the cutting device (4).

6 Claims, 9 Drawing Sheets

(56) References Cited

U.S. PATENT DOCUMENTS

| | | | | | |
|---|---|---|---|---|---|
| 4,522,241 | A * | 6/1985 | West | B27L 7/00 | 144/195.1 |
| 4,546,440 | A * | 10/1985 | Palmberg | B23D 35/001 | 144/357 |
| 4,800,937 | A * | 1/1989 | Mangus, Sr. | 144/195.1 | |
| 4,922,773 | A * | 5/1990 | Ito | 83/76.6 | |
| 4,968,204 | A * | 11/1990 | Griveau | G21C 19/36 | 414/15 |
| 6,763,748 | B2 * | 7/2004 | Wolcott | B26D 7/32 | 83/155 |
| 6,837,030 | B2 * | 1/2005 | Drebing | B26D 1/16 | 53/250 |
| 6,935,215 | B2 * | 8/2005 | Lindee | B26D 7/0683 | 83/155 |
| 7,213,493 | B2 * | 5/2007 | Cote et al. | 83/273 | |
| 2001/0047705 | A1 * | 12/2001 | Gambini | 83/330 | |
| 2002/0170398 | A1 * | 11/2002 | Verhaeghe | 83/13 | |

* cited by examiner

APPARATUS AND METHOD FOR MOVING LOGS WITHIN CUTTING-OFF MACHINES

CROSS REFERENCE TO RELATED APPLICATIONS

This application is a continuation under 37 CFR 1.53(b) of pending prior application Ser. No. 10/547,435 filed Aug. 25, 2005 now abandoned and claims the benefit under 35 U.S.C. § 119 of International Application PCT/IT2004/000139 of Mar. 22, 2004, which designated inter alia the United States and which claims the priority of Italian Application FI2003A000115 of Apr. 24, 2003. The entire contents of each application is hereby incorporated by reference in its entirety.

FIELD OF THE INVENTION

The present invention pertains to an apparatus and a method for moving logs within cutting-off machines. In the following text, the term "logs" is meant to indicate rolls of web material (such as paper) wound up around a support core (for example, a tubular cardboard core), to be cut to form rolls of smaller length, that is, of commercial size.

BACKGROUND OF THE INVENTION

The production of paper rolls is known to involve cutting transversally the logs, produced by a rewinding machine, by using one or more cutting-off machines.

A cutting-off machine for logs is described in details in the patent IT 1247330.

Essentially, a cutting-off machine of this type comprises:

a plurality of channels or guides into which the logs are discharged and in correspondence of which movable devices, so-called "porters" in jargon, are mounted to drive the logs into longitudinal motion by pushing them from behind;

a cutting station, comprising one or more circular blades, rotating about axes parallel to those of the logs and fixed on a corresponding movable support.

During the normal operation, a log to be cut is disposed, by a relevant porter, in a preset position on the respective guide and blocked in such position; then, one of the blades is actuated, that is, it is driven into a plane orthogonal to the axis of the log, so as to form a shorter roll of preset size therefrom. The length of the roll depends, actually, on the advancement of the porter during the time elapsing between two consecutive cuts operated by the blades.

In particular, the feeding of the logs to the cutting means is of discontinuous nature, as an empty space results all the time between one log and the next, and because it is in fact impossible to use the system with porters of known type to feed the logs continually.

Such discontinuity in the supply brings about a decreased production, in terms of number of rolls per hour being produced, with respect to the actual capacity of the system. A further drawback is that the components of the system are likely to collide with each other in case of failures in the system predisposed for moving the porters and the cutting means in synchronism, which affects negatively the economy of the manufacturing process.

SUMMARY OF THE INVENTION

The main object of the present invention is to overcome the above drawbacks.

This result has been achieved, according to the invention, by adopting the idea of a structure and a method having the characteristics described in independent claims. Further characteristics being set, forth in the dependent claims.

The present invention makes it possible to continuously feed the logs to cutting means, with no interruptions nor empty spaces between consecutive logs, which allows improving significantly the actual output of the system and without any interference between the means for driving the logs and the cutting means. Moreover, an apparatus according to the invention is relatively easy to make, cost-effective and reliable even after a prolonged service life.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENT

Figure 1:
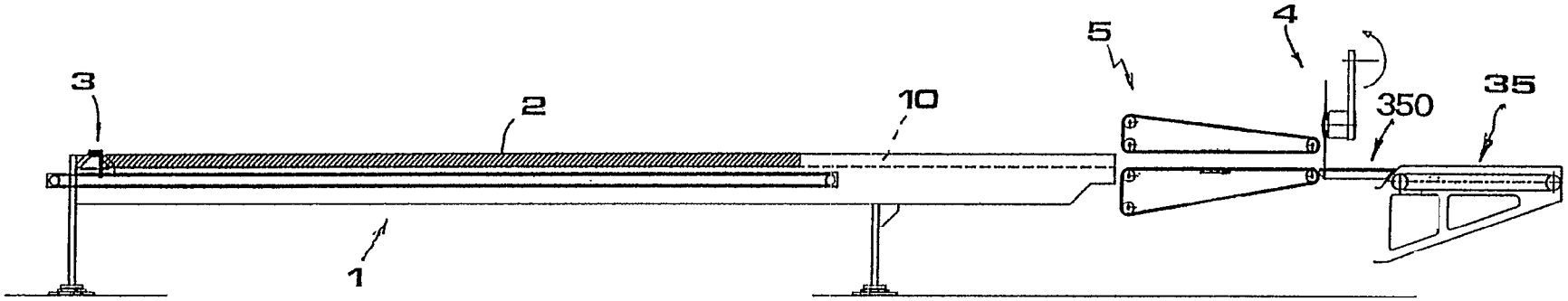
FIG. 1 is a schematic side view of an apparatus, according to the invention, showing the step at the beginning of a work cycle.

Reduced to its basic structure, and reference being made to the figures of the attached drawings, an apparatus according to the invention comprises:

a platform (1) with one or more longitudinal channels (10) inside which the logs to be cut are disposed;

pusher means (3) acting in correspondence of said platform (1) and intended for acting on the back of the logs (2) to push them, along respective guide channels (10), toward cutting means (4) disposed downstream;

clamping means (5) disposed intermediate between said pusher means (3) and said cutting means (4) and intended for engaging the logs (2) which are pushed along the channels (10) of platform (1) by the pushers (3) and driving them along as far as said cutting means (4).

Figure 14:
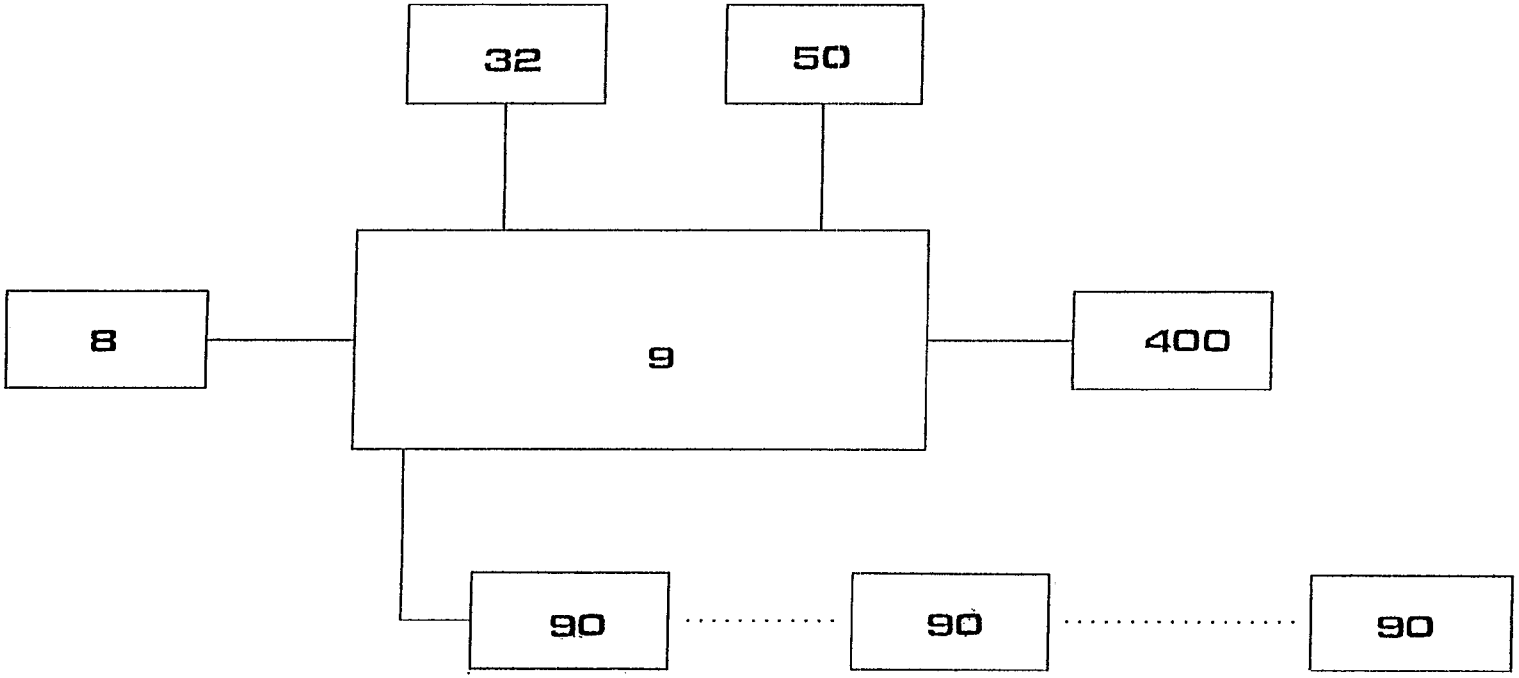
FIG. 14 is a simplified block diagram of the automatic drive and control means.

Advantageously, the pusher means (3) comprise a bar (30) disposed transverse to the channels (10) of platform (1) and moved to and from the clamping means (5) by a carriage (31) associated with a corresponding electric motor (32) (shown only in the block diagram of FIG. 14) and mounted for sliding on the two long sides of platform (1).

Moreover, advantageously, the clamping means (5) are made up of two motor-driven, loop-closed belts (50) disposed opposite to each other, with respect to the plane (2) on which the logs (2) arrive sliding on the platform (1), so that each belt will always exhibit a length (51) parallel to such plane: the lengths facing each other (51) of the belts (50) being spaced apart of an extension substantially equal to the outer diameter of the logs (2).

For example, reference being made to the attached drawings, the cutting means (4) comprise a blade (40) mounted on a support arm (41) which is associated with a relevant actuator (400) (see block diagram of FIG. 14) to drive it into motion from and to the logs (2) to be cut.

The operation of the above described apparatus is as follows.

Figure 2:
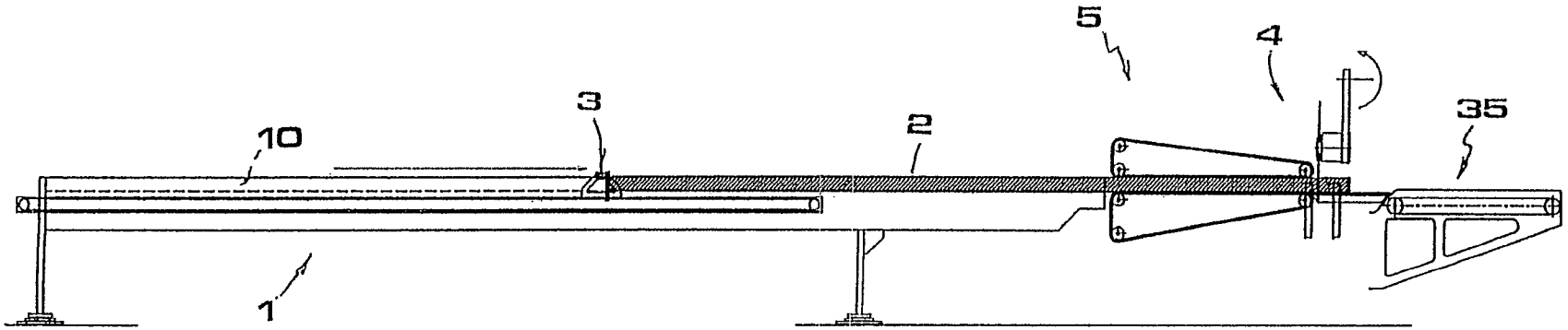
FIG. 2 is a schematic side view of the apparatus of FIG. 1 with a log engaged by clamping means and subjected to a cutting operation.
Figure 3:
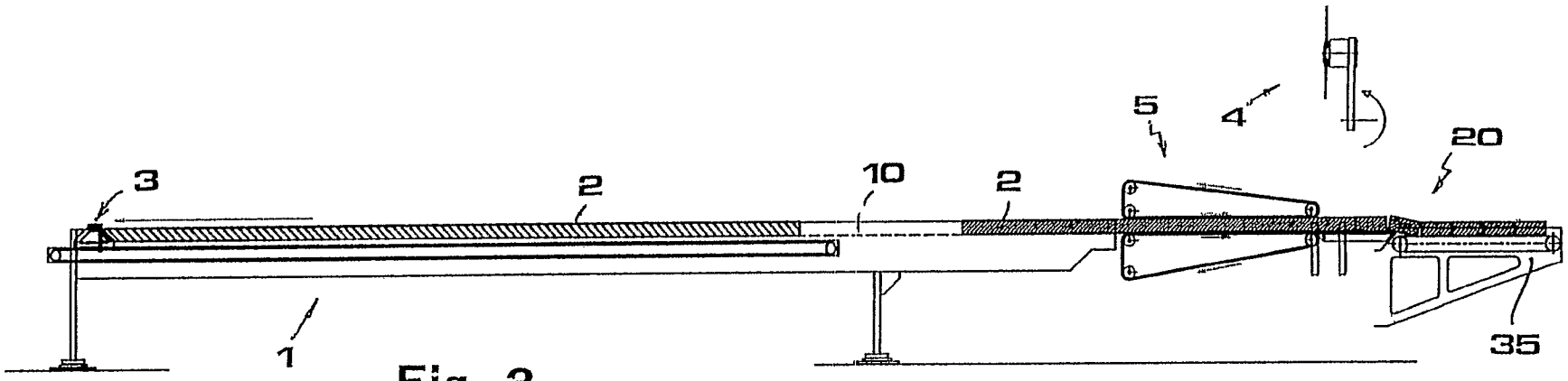
FIG. 3 is a schematic side view of the apparatus of FIG. 1 with another log loaded onto the respective channel of the platform for the sliding of the logs.
Figure 4:
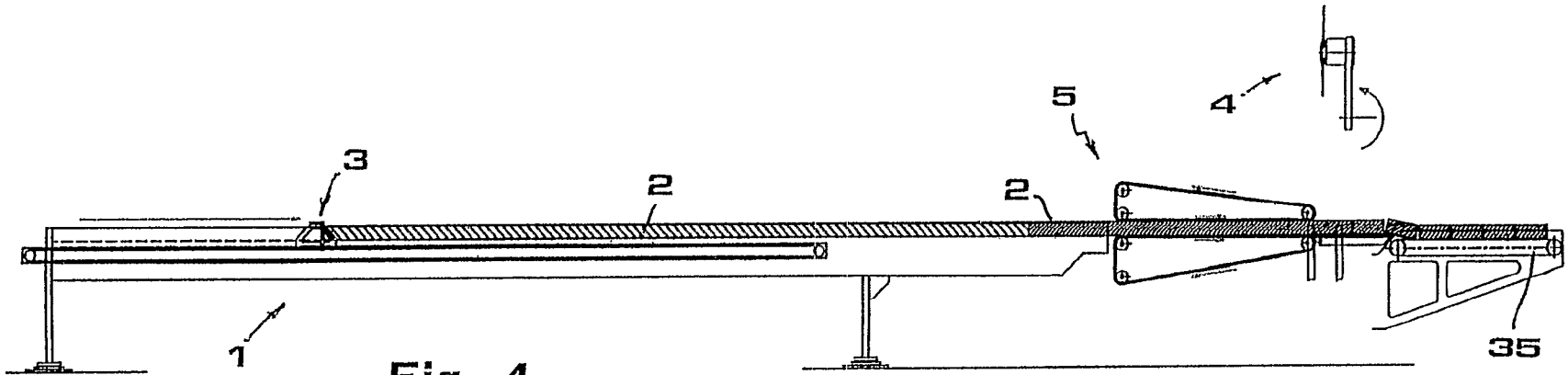
FIG. 4 is a schematic side view of the apparatus of FIG. 1 with two logs lined up one after the other.
Figure 5:
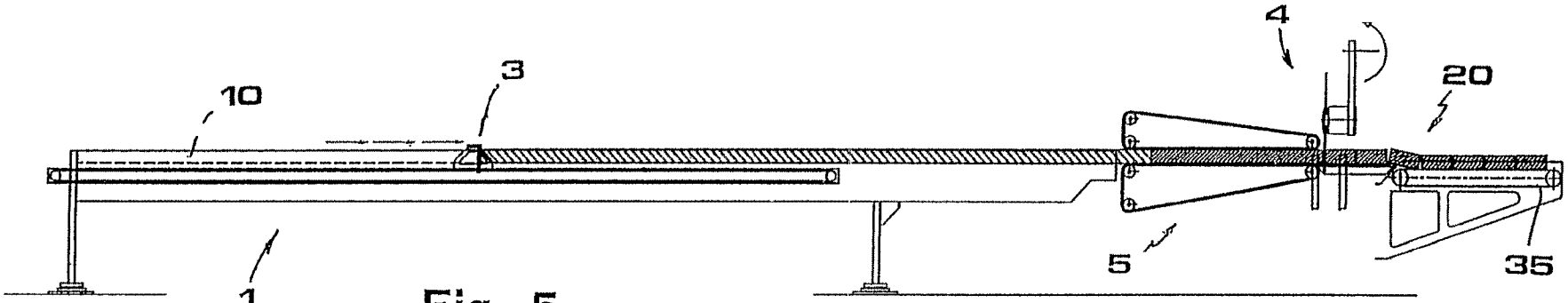
FIG. 5 is a schematic side view of the apparatus of FIG. 4 with the second log having its head section positioned between the clamping means.
Figure 6:
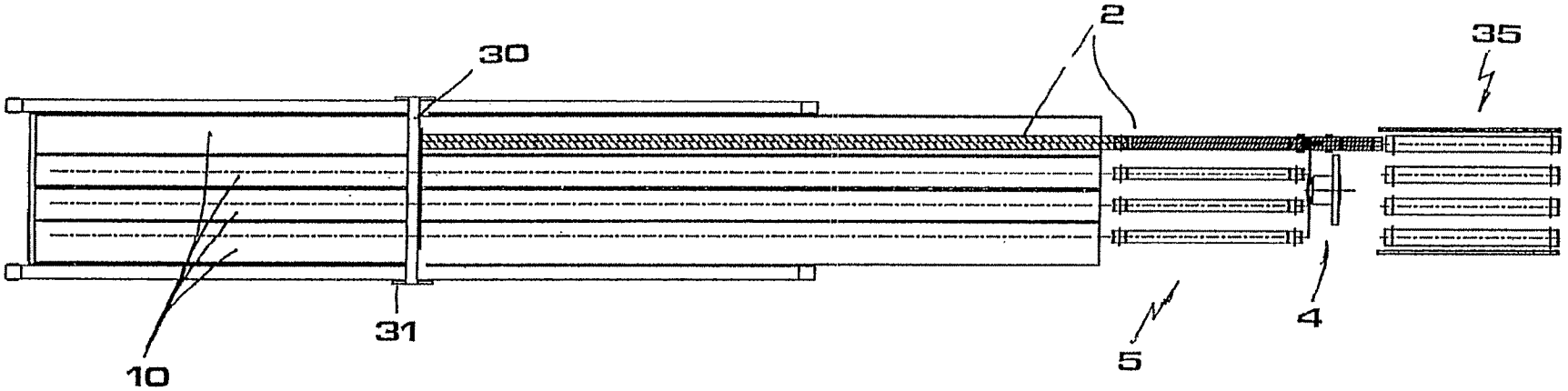
FIG. 6 is a plan view of the apparatus of FIG. 5.
Figure 7:
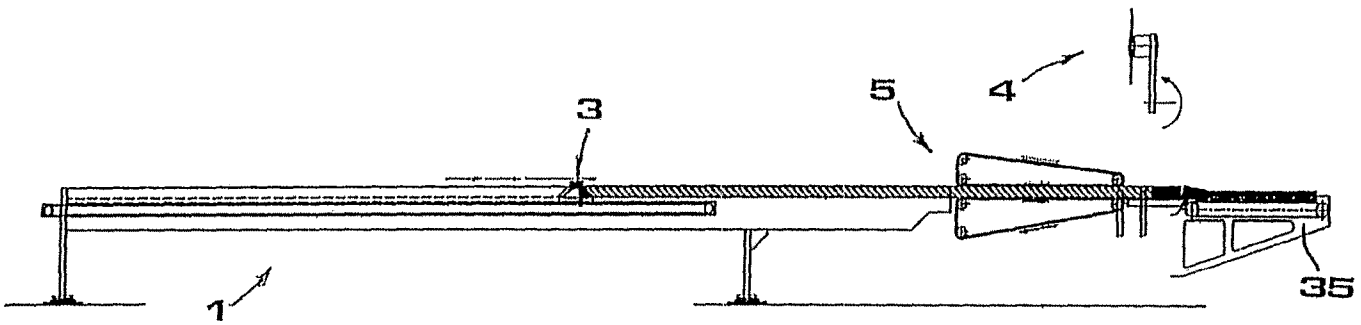
FIG. 7 is a schematic side view of the apparatus of FIG. 6 in an operating step that follows the one represented in FIG. 6
Figure 8:
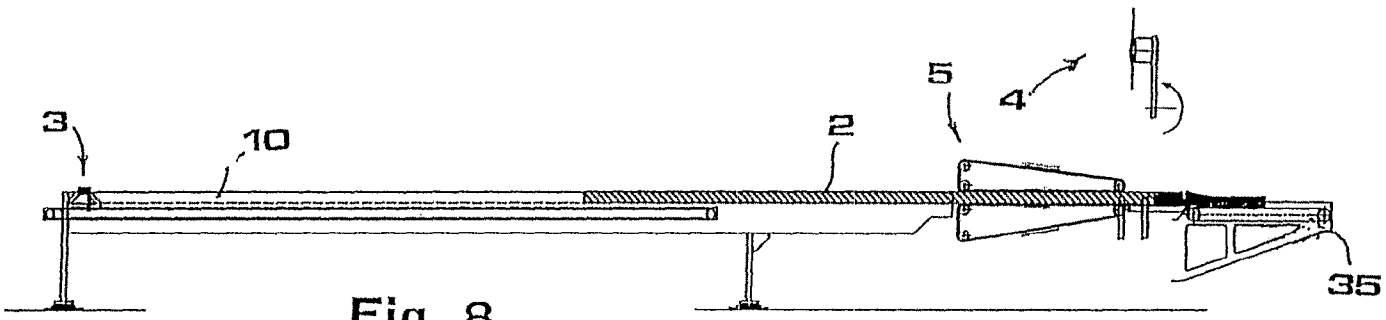
FIG. 8 is a schematic side view of the apparatus of FIG. 6 in another operating step that follows the one represented in FIG. 7.
Figure 9:
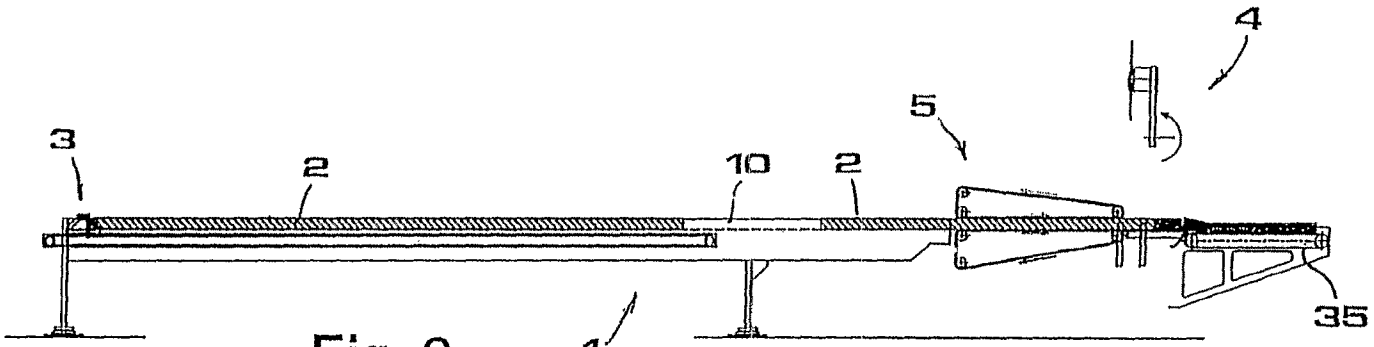
FIG. 9 is a schematic side view of the same apparatus in a further step, with another log loaded on the platform.

The logs (2) are disposed in the channels (10) of platform (1) by automatic loading devices (known to those skilled in the art and, therefore, not to be described herein in detail), and the pusher means (3) provide for pushing them toward the belts (50) as far as between the parallel lengths (51) of the latter (FIGS. 1 and 2). At this point, each log (2) thus positioned results retained between the same belts (50) which, by rotating on respective driving-out rollers, direct the log toward the cutting means (4), as illustrated in FIG. 3, and engage the same log on diametrically opposite surface portions thereof. The movement of the belts (50) and thus of logs (2), is intermittent and in synchronism with the cutting means (4): in correspondence of each dwell, the means (4) are active, so that the logs (2) are cut, whereas during the movement of belts (50) the means (4) are inoperative and away from the logs (2). The speed and time of operation of the belts (50) are predetermined in relation to the length of paper rolls (20) to be obtained from the cutting of the logs (2). Once the logs (2) are held between the belts (50), the carriage (31) moves back to take up the relevant initial position, so that, when disposing further logs (2) in the channels of platform (1), these logs can be driven, again by the same pusher means, as far as to dispose the relevant head portions thereof in contact with the tail sections of the logs (2) previously handed over to the belts (50), as illustrated in FIG. 4. This process is cyclically repeated, as illustrated also in FIGS. 5-9. It thus follows that the feeding of the logs (2) to the cutting means is performed continuously, that is, without interruptions or empty spaces between consecutive logs, with evident advantages in terms of actual production of the system. The rolls, as they are produced, (20) are pushed by the same logs (2) being treated onto a conveyor belt (35) located downstream of the cutting means (4) which provides for moving them away. Possibly disposed between the conveyor belt (35) and the cutting means (4) is a stationary horizontal plane (350).

An operating method according to the invention includes, therefore, a step of push-operated longitudinal movement of the logs (2) to be cut, and a subsequent step of pull-operated longitudinal movement of the same logs (2).

The method in question may be carried out, for example, by means of the previously described apparatus and allows a continual feed of logs (2) to be obtained owing to the combination of the push and pull actions on the logs (2).

When trimmed logs are loaded onto the platform (1), it is also possible to obtain a more uniform cut quality from the first to the last of the rolls obtained from each log. It is also possible to move the belts (50) in such a manner to perform a double step of the latter when there is the passage of the tailing section of a log and of the heading section of the subsequent log in correspondence of the cutting means (4). In this case, a trimming of the logs is not to be provided (whereas, on the contrary, it is normally provided for not trimmed logs). Use of trimmed logs contributes to further increase the production.

Advantageously, in correspondence of the cutting means (4), further means (6) may be provided intended for temporarily retaining the logs (2) during the cutting step, that is, when the cutting means are activated.

The retention means (6), according to the exemplary embodiment illustrated in the figures of the attached drawings, comprise two plates (60*a*, 60*b*) each of which exhibits, on one side, a plurality of rigid, substantially semicircular hooks—hereinafter referred to as "pressers"—and, on the opposite side, an appendix (600) slidingly fitted within a guide (7) inclined at a predetermined angle to the vertical: the plates, (60*a*, 60*h*) being associated with an actuator (8) which, under control, drive them into a substantially rectilinear motion in the direction of the respective guides (7), and the same plates being disposed in parallel and mirror-like relationship, that is, orthogonally to the logs (2) to be treated.

The appendixes (600) of the plates, (60*a*, 60*b*) are provided with small rollers (63) to assist the sliding thereof within the respective guides (7).

Preferably, the guide (7) is inclined at an angle of 60° to 65° to the vertical in order to achieve what it is deemed to be an optimal combination of vertical and horizontal components of the displacement of each presser (61), and to allow the apparatus to work as best as possible whatever the diameter of the logs under treatment, thus resulting extremely versatile.

For example, the actuator (8) may be an electric motor connected to the two plates (60*a*, 60*b*) via a transmission device of crank-connecting rod type (80, 81) acting on pivots (83) going through the two plates (60*a*, 60*b*): the plates (60*a*, 60*b*) being engaged to a fixed body (100) via corresponding levers (108) each of which, on one side, is hinged to one of the two fixed bodies (100) and, on the other side, is hinged to one of the two plates (60*a*, 60*b*) above the pivots (83). The axes of the hinges, connecting the levers (108) with the plates (60*a*, 60*b*), being parallel to the pivots (83).

Figure 10:
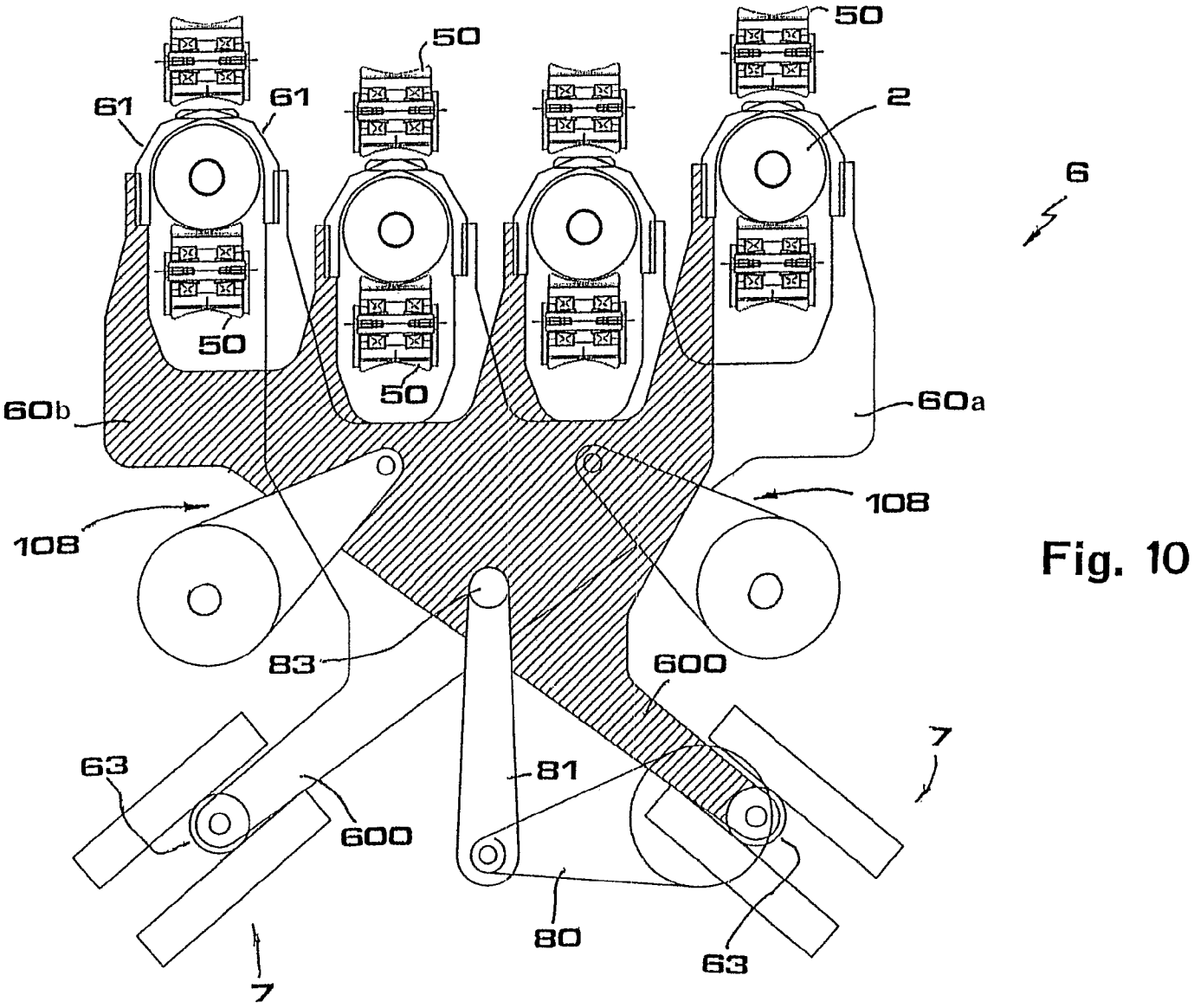
FIG. 10 is a schematic front view of the configuration taken up by the means for the temporary retention of logs of one diameter in the cutting-off station.
Figure 11:
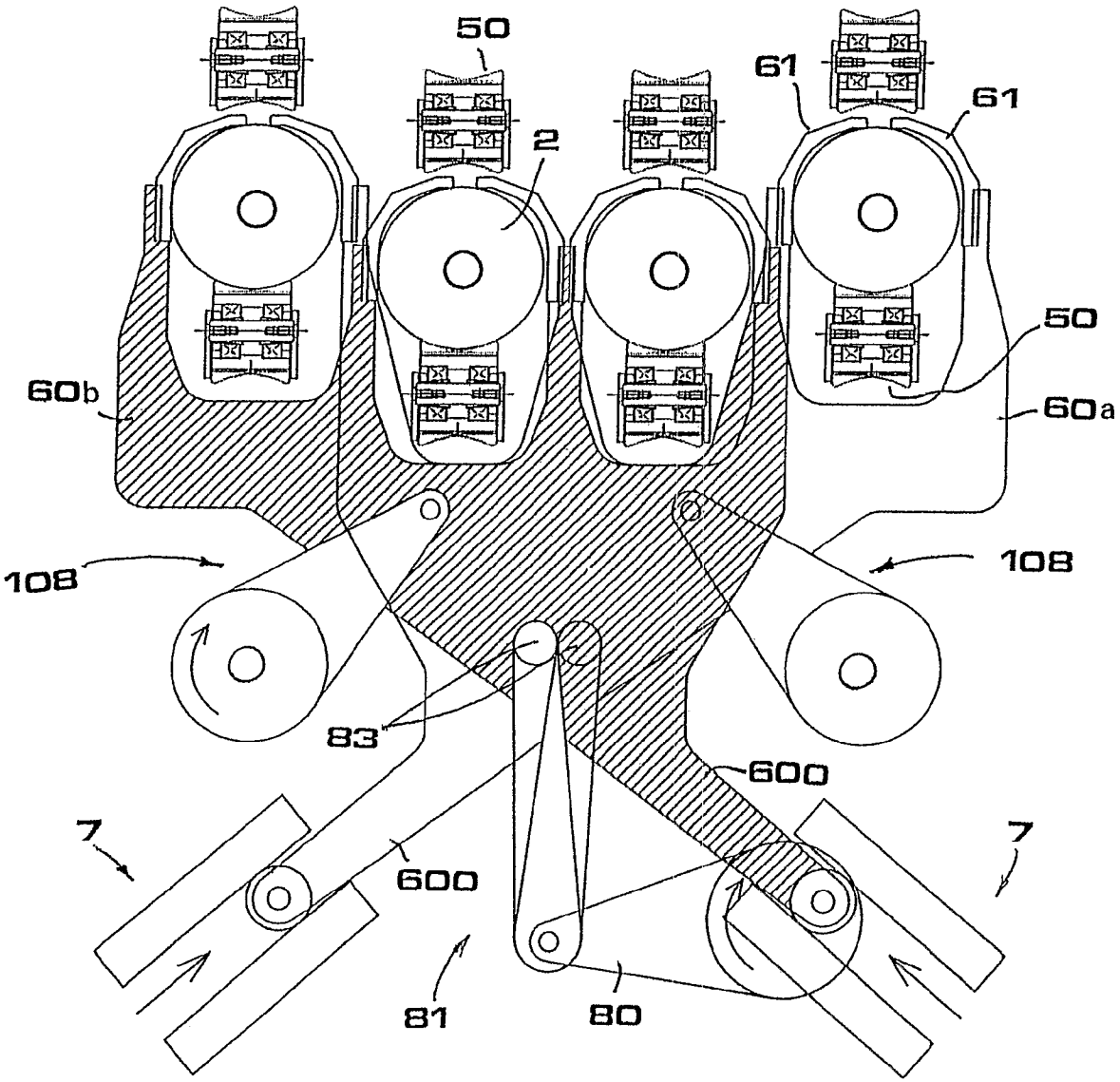
FIG. 11 is a schematic front view of the configuration taken up by the means for the temporary retention of logs of another diameter in the cutting-off station.
Figure 12:
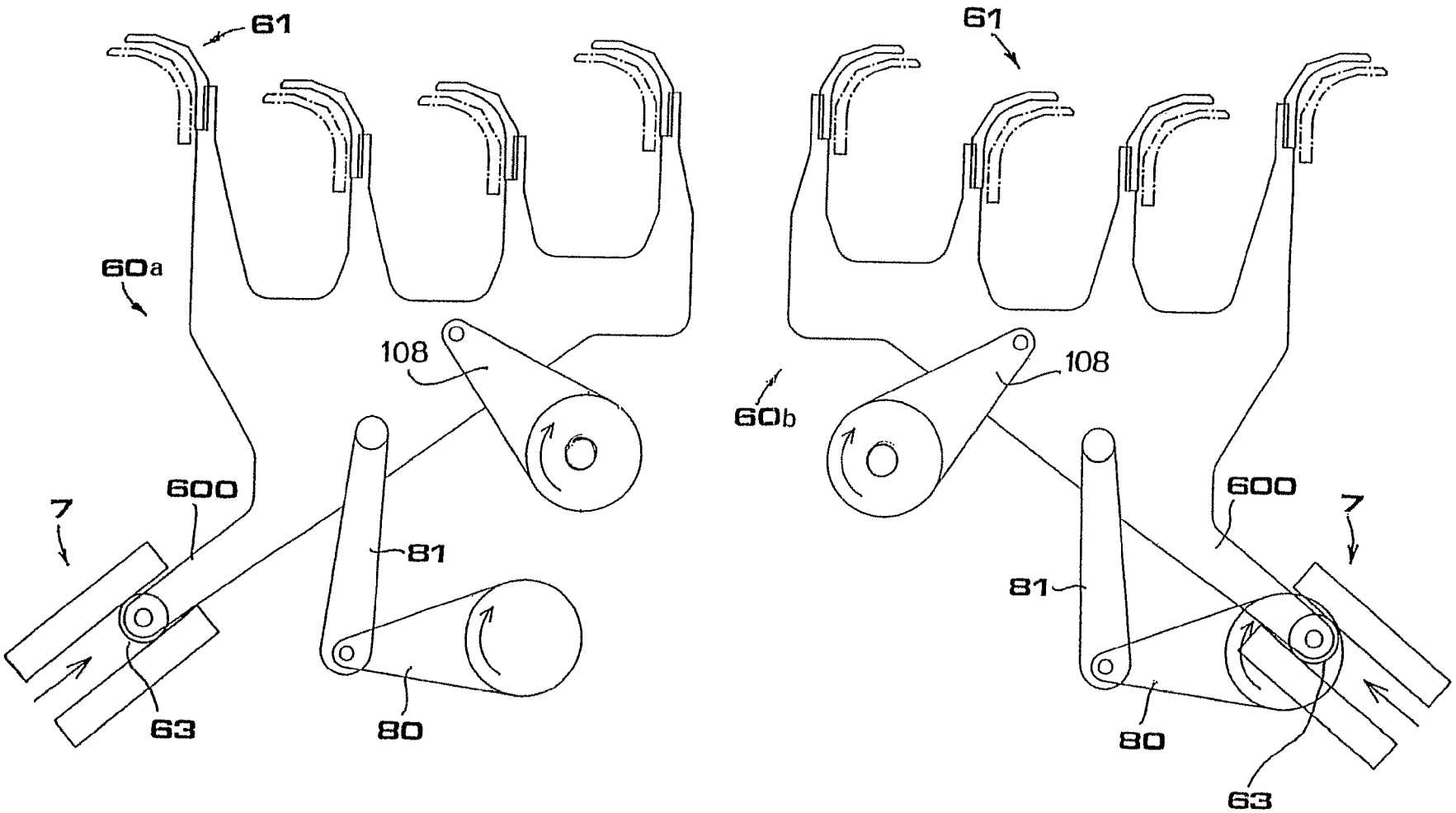
FIG. 12 is a schematic exploded side view of the retention means illustrated in FIGS. 10 and 11.
Figure 13:
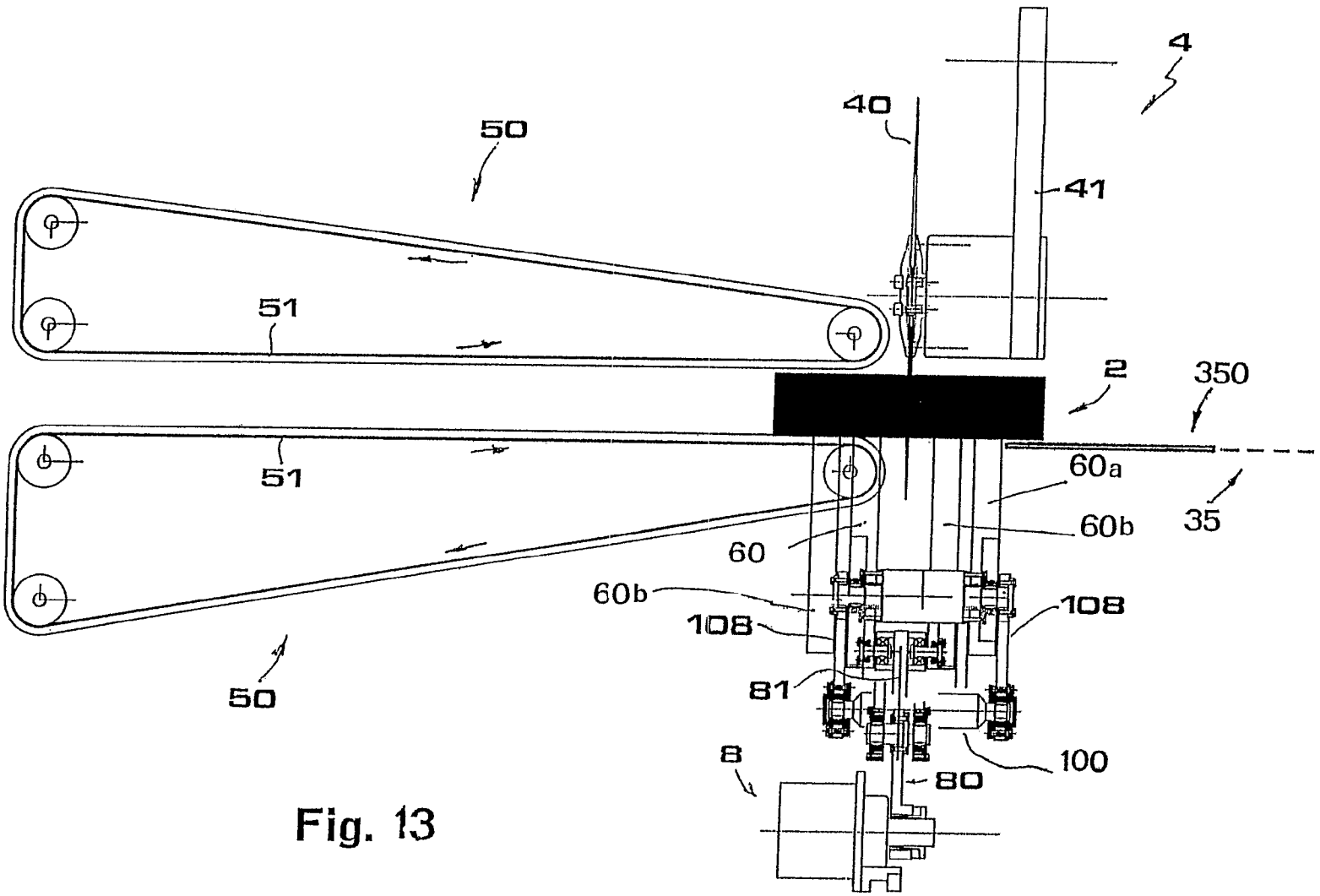
FIG. 13 is a schematic side view of the retention means illustrated in FIGS. 10 and 11.

When the cutting means (4) are inoperative and away from logs (2), the plates (60*a*, 60*b*) are lifted (as shown with dashed line in FIG. 12) so that the logs (2) result free of translating forwards (owing to the pull exerted thereon by the belts 50). Just before the beginning of the step for the cutting of logs (2), that is, when these result in cutting position, the plates (60*a*, 60*b*) are lowered (see FIGS. 10 and 11 and the drawing with solid lines in FIG. 12) by compressing the surface of the logs by means of the hooks (61) which, being approximately semicircular and in mirror-like relationship, embrace the logs laterally and on top as well, thereby retaining them in the preset position. At the bottom, the logs (2) rest in part on respective belts (50) and in part on the plane (350). The lowering and lifting of the plates (60*a*, 60*b*) is caused by the actuator (8) via the array of levers above mentioned.

The controls of pusher means (3), clamping means (5), cutting means (4) and actuator (8), the latter operating the translation of plates (60*a*, 60*b*), are all automated via corresponding programmable electronic means to which optical, photocell-operated, control means (90) are also connected, the latter being disposed along the operative path of the logs (2) at known and preset positions. Such electronic means are known to those skilled in the industrial automation field and will not, therefore, be described in greater detail.

While specific embodiments of the invention have been shown and described in detail to illustrate the application of the principles of the invention, it will be understood that the invention may be embodied otherwise without departing from such principles.

What is claimed is:

1. An apparatus for moving logs within cutting-off machines, the apparatus comprising:

a cutting means for cutting uncut logs and subdividing each uncut log into a plurality of cut rolls, each of the uncut logs comprising web material wound around a support core, each of said cut rolls having an axial length and a radial length, said axial length being greater than said radial length;

a horizontal platform defining a plurality of horizontal longitudinal channels for receiving uncut logs;

a log pusher element extending in a direction transverse to said plurality of horizontal longitudinal channels, said log pusher element comprising a planar uncut logs engaging surface extending continuously, without interruption from one side of said log pusher element to another side of said log pusher element, said planar uncut logs engaging surface being perpendicular to said longitudinal channels, said planar uncut logs engaging surface comprising a first planar log engaging surface and a second planar log engaging surface, said log pusher element engaging the uncut logs and pushing each uncut log along one of said plurality of longitudinal channels, wherein said log pusher element and each of the uncut logs move relative to said platform, said log pusher element having a length greater than a width of said plurality of longitudinal channels, said cutting means being located downstream of said log pusher element, said log pusher element being movably connected to said platform such that said log pusher element reciprocates in an exclusively linear and horizontal direction between an initial position and an end position;

a clamping means for clamping the uncut logs received from said plurality of horizontal longitudinal channels of said platform via said log pusher element and for driving the uncut logs to said cutting means, said clamping means not being provided between said horizontal longitudinal channels of said platform, said first planar log engaging surface portion engaging a back end of one of the uncut logs and pushing the one of the uncut log along one of said plurality of longitudinal channels toward said clamping means, said second planar log engaging surface portion engaging another back end of another one of the uncut logs and pushing the another one of the uncut logs along another one of said plurality of longitudinal channels toward said clamping means, said first planar log engaging surface portion being located adjacent to said one of said plurality of longitudinal channels, said second planar log engaging surface portion being located adjacent to said another one of said plurality of longitudinal channels, said clamping means being disposed between said log pusher element and said cutting means, said clamping means comprising a first endless belt and a second endless belt, said first endless belt being located at a position above the uncut logs, said second endless belt being located at a position below the uncut logs, said first endless belt being disposed opposite said second endless belt, with respect to a plane on which the uncut logs arrive sliding on said platform, such that each of said first endless belt and said second endless belt has a belt portion horizontal and parallel to the plane, said belt portion of said first endless belt and said belt portion of said second endless belt defining a log receiving space, said log receiving space being substantially equal to an outer diameter of one of said uncut logs such that said one uncut log is received between said belt portion of said first endless belt and said belt portion of said second endless belt, said length of said log pusher element being greater than the outer diameter of said uncut logs, said log pusher element moving from said end position to said initial position immediately upon said clamping means clamping the uncut logs, wherein said platform is in a stationary position relative to said log pusher element and said clamping means;

an output conveying means downstream of the cutting means, the output conveying means comprising a horizontal conveyor belt such that the cut rolls are prevented to rotate downstream of the cutting means, wherein movement of said first endless belt and said second endless belt is synchronized with movement of said cutting means such that said first endless belt and said second endless belt move the uncut logs when said cutting means is not actuated and said cutting means cuts the uncut logs when said first endless belt and said second endless belt do not move the uncut logs, said uncut logs being arranged in a single platform plane, said first endless belt and said second endless belt receiving said uncut logs in a single endless belt plane, said output conveying means receiving said cut rolls in a single output conveying means plane, each of said single output conveying means plane, said single endless belt plane and said single platform plane being aligned with one another to define a single uncut logs and cut rolls plane, wherein the uncut logs and the cut rolls are moved exclusively in a horizontal direction in said single uncut logs and cut rolls plane;

a carriage; and a motor, said log pusher element being connected to said carriage and said motor, said log pusher element comprising a bar, said bar moving exclusively between said initial position and said end position via said carriage and said motor, said bar moving the uncut logs in said exclusively linear and horizontal direction of said clamping means when said bar means moves from said initial position to said end position via said carriage and said motor, said bar moving from said end position to said initial position in an exclusively linear and horizontal direction opposite said clamping means immediately upon said clamping means receiving the uncut logs, said bar comprising said uncut log engaging surface for engaging the uncut logs, said uncut log engaging surface being substantially perpendicular to each of said longitudinal channels and a longitudinal axis of said platform, said first endless belt and said second endless belt being associated with one of said longitudinal channels, said clamping means comprising a third endless belt and a fourth endless belt, wherein said third endless belt and said fourth endless belt are associated with another one of said longitudinal channels, said belt portion comprising a planar uncut log contacting surface, said planar uncut log contacting surface engaging each of the uncut logs without damaging the uncut logs, said clamping means being in direct contact with a top area and a bottom area of each of said uncut logs.

2. An apparatus in accordance with claim 1, wherein said log pusher element extends continuously from one side of said platform to another side of said platform in the direction transverse to said longitudinal channels, one end of said log pusher element being movably connected to one side of said platform and another end of said log element being movably connected to another side of said platform such that said log pushing element slides along said platform, wherein at least a portion of said log pusher element is located above a portion of each of said plurality of longitudinal channels, said initial position being located adjacent to one portion of said platform, said end position being located adjacent to another portion of said platform, wherein said one portion of said platform is located at an axially spaced location from said another portion of said platform with respect to a longitudinal axis of said platform, said pusher element engaging each of the uncut logs in said longitudinal channels, wherein said uncut logs being arranged in said longitudinal channels of said platform such that said uncut logs define an exclusively horizontally spaced lateral arrangement of uncut logs, said pusher element simultaneously moving each of said uncut logs in said exclusively horizontally spaced lateral arrangement of uncut logs from said initial position to said end position, said clamping means receiving said exclusively horizontally spaced lateral arrangement of uncut logs and moving said exclusively horizontally spaced lateral arrangement of uncut logs in a direction of said cutting means such that said uncut logs are maintained in said exclusively horizontally spaced lateral arrangement of uncut logs when said uncut logs are moved via said clamping means, wherein each of the uncut logs remains in said exclusively horizontally spaced lateral arrangement of uncut logs by said clamping means while said cutting means cuts each of the uncut logs in said exclusively horizontally spaced lateral arrangement of uncut logs.

3. An apparatus in accordance with claim 1, wherein said platform has a platform dimension defined in a direction transverse to each of said longitudinal channels, said length of said log pusher element being at least equal to said platform dimension, wherein said log pusher element moves in linear and horizontal direction from said initial position to said end position and from said end position to said initial position, said log pusher element being in direct contact with at least one of the uncut logs as said log pusher element moves from said initial position to said end position.

4. An apparatus in accordance with claim 1, wherein said platform dimension is a width of said platform, said platform having a first side platform portion extending parallel to each of said longitudinal channels and a second side platform portion extending parallel to each of said longitudinal channels, said first side platform portion and said second side platform portion defining said width of said platform, wherein one end portion of said log pusher element engages said first side platform portion and another end portion of said log pusher element engages said second side platform portion.

5. An apparatus in accordance with claim 1, wherein the linear and horizontal direction is parallel to a longitudinal direction of the horizontal longitudinal channels.

6. An apparatus in accordance with claim 1, wherein the end position is located between a first end of the horizontal platform and a second end of the horizontal platform, wherein the end position is located at a spaced location from the first end and the second of the horizontal platform.

* * * * *